US006430759B1

(12) United States Patent
Beltran

(10) Patent No.: US 6,430,759 B1
(45) Date of Patent: Aug. 13, 2002

(54) SYSTEM FOR FASTENING BATHROOM ACCESSORIES

(75) Inventor: Jose M. Ferrer Beltran, Bonrepos (ES)

(73) Assignee: Ibergesfer, S.L., Bonrepos (ES)

( * ) Notice: Subject to any disclaimer, the term of this patent is extended or adjusted under 35 U.S.C. 154(b) by 0 days.

(21) Appl. No.: 09/862,010

(22) Filed: May 21, 2001

(51) Int. Cl.[7] ..... A47K 3/022
(52) U.S. Cl. ..... 4/576.1; 211/105.1; 248/251
(58) Field of Search ..... 4/559, 576.1; 211/105.1, 211/105.2; 248/251

(56) References Cited

U.S. PATENT DOCUMENTS

| | | | | | |
|---|---|---|---|---|---|
| 1,962,739 | A | * | 6/1934 | Hoegger | 248/251 X |
| 3,098,240 | A | * | 7/1963 | Fleenor | 4/576.1 |
| 4,944,478 | A | * | 7/1990 | Sullivan | 248/205.7 |
| 5,307,528 | A | * | 5/1994 | Nieuwenhuis et al. | 4/576.1 |
| 6,199,808 | B1 | * | 3/2001 | Lin | 248/222.14 |

* cited by examiner

*Primary Examiner*—Charles E. Phillips
(74) *Attorney, Agent, or Firm*—Lackenbach Siegel, LLP

(57) ABSTRACT

The "system for fastening bathroom accessories" which is the object of this patent and whose preferred embodiment is that expressed in the title of the invention.

Its structure is comprised of:

a back piece for attachment to the wall, which has on its front side a protrusion shaped like a right rectangular prism;

a bell-shaped trimming body of ellipsoid surface, the interior of which has a tubular volume for the prism, and a threaded hole for the passage of a set-screw for joining the piece, as well as an axial tubular extension in its polar region;

a T-shaped tubular piece whose central arm is placed in the tubular extension, the two pieces being joined by means of a screw;

two elastic sleeves which have straight depressions which form keys, with thickenings which fit into circumferential slots which are located in the ends of the rods whose function is to support the accessories.

2 Claims, 5 Drawing Sheets

SECTION B-B

SECTION A-A

SECTION A-A

SECTION B-B

SECTION A-A

SECTION B-B

SECTION A-A

SYSTEM FOR FASTENING BATHROOM ACCESSORIES

PURPOSE

The purpose of the invention protected by the present patent comprises a "system for fastening bathroom accessories."

The fastening to which the claimed system applies is the one that is required between the means of support of the accessory and the surface of the wall or partition of the bathroom or washroom in which the accessories are used.

BACKGROUND

Numerous systems for fastening bathroom accessories are known, all of which must fulfill certain requirements, such as:

Multiple use: applicability to any accessory (towel racks, toilet paper holders, soap dishes, shelves, etc.).

Sufficient mechanical strength to withstand stresses, always relatively low, encountered during its use.

Concealment of the means of attachment to a wall, generally screws and wall plugs.

Stylistic unity, a homogeneous esthetic condition derived from the diversity of the applications of the supports.

Although known fastening systems claim to fulfill all of the requirements indicated, they do not always accomplish this, at least not simultaneously and to the same degree.

DESCRIPTION OF THE INVENTION

The purpose of the invention which is the object of this patent comprises the concept and the implementation of a new system for fastening bathroom accessories which, while completely fulfilling all of the general requirements described above, is also an improvement over known systems.

Along these lines can be included the development of compression joints with the use of resilient sleeve clips, which are used in joining some pieces, as described below.

The structure of the claimed system itself is comprised of the following elements:

A back piece for fastening to the wall, in the shape of a thin disk, which has on its front side a central protrusion shaped like a right rectangular prism, which in its lower side, when in the position of use, has a circular penetration, and has two throughholes placed along a diameter vertical to it, on each side of the central prism.

A bell-shaped trimming body whose lateral surface is shaped like that of a semi-ellipsoid of revolution, which in its interior has a tubular volume centered along its axis, square in shape and with inner dimensions slightly larger than the outer dimensions of the central prism of the back piece, to allow tight introduction of the latter into the former; and which in the lower portion of the tubular volume, in its position of use, has a solid extension which is traversed vertically by a threaded hole which emerges at the outside, for the passage of a set-screw whose end is placed into the circular penetration of the interior prism of the back piece, joining it securely and immovably to the trimming body; having also a cylindrical tubular extension in the polar region of the ellipsoidal surface and co-axial to it.

A T-shaped cylindrical tubular piece whose central arm whose inside is threaded and has an outer diameter tightly adjusted to the inner diameter of the cylindrical extension of the trimming body in order to facilitate its placement inside it, the joining of the two pieces being accomplished by means of an Allen screw which is introduced through the tubular extension of the trimming body and the threading in the central arm of the T, the end of said tubular extension being adjusted to the transverse body of said T-piece by means of the suitable configuration.

Two sleeves of a semi-elastic material which are of uniform diameter approximately two-thirds of their length, while the remaining third is of a slightly larger diameter and has four straight depressions in the direction of its generatrix, two of each facing one another in as many orthogonal axes, and each of the keys thus formed having thickenings in their respective inner surface which allow them to be joined under pressure into circumferential slots which the straight outgoing rods of the transverse arm of the T-piece comprise near their ends, whose function is the support of the corresponding accessory.

The assembly of the system is accomplished according to the following sequence of operations:

Fastening the back piece to the wall by means of screws and wall plugs.

Joining of the trimming body and the T-piece by means of an Allen screw introduced through the tubular extension of the trimming body and threaded into the central arm of the T-piece which is located in said extension.

Joining of the back piece and the trimming body joined to the T-piece by means of the lower set screw.

Joining of the T-piece and the support rods of the accessories by means of several semi-elastic sleeves introduced first into the T-piece through its castellated portion and subsequently into the ends of the rods through their straight cylindrical portion, both elements thus been "clipped" in a virtually irreversible manner.

BRIEF DESCRIPTION OF THE DRAWINGS

In order to complement the description of the invention and to facilitate the interpretation of the formal, structural and functional characteristics regarding its purpose, drawings are included which represent schematically the different aspects of the preferred embodiment of the "system for fastening bathroom accessories" which is the object of this patent.

In said drawings depict.

DESCRIPTION OF A PREFERRED EMBODIMENT

Figure 4:
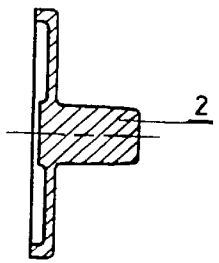
FIG. 4 a section through the plane along line B—B in FIG. 1.
Figure 3:
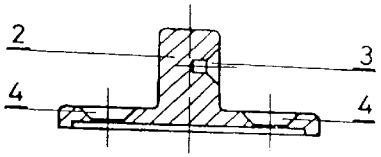
FIG. 3 a section through the plane along line A—A in FIG. 1.
Figure 1:
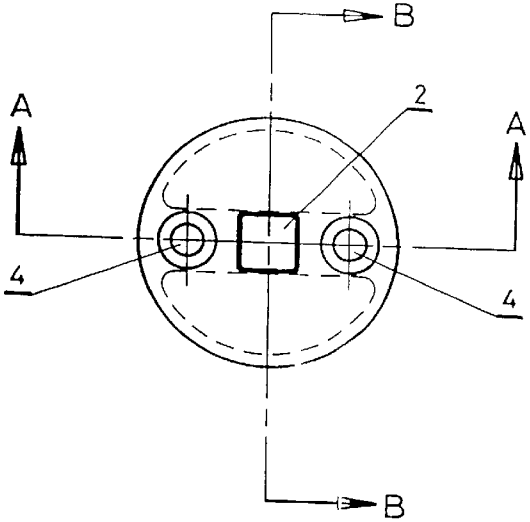
FIG. 1 a view from below of the back piece.
Figure 5:
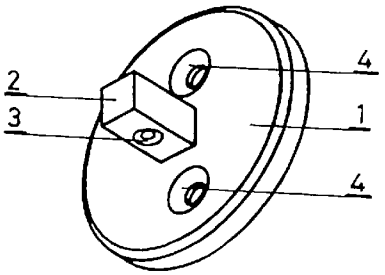
FIG. 5 a perspective view of said back piece.
Figure 2:
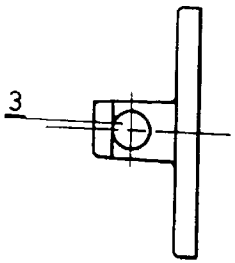
FIG. 2 an elevation of same, seen from the lower side of its prismatic protrusion when in the position of use.
Figure 9:
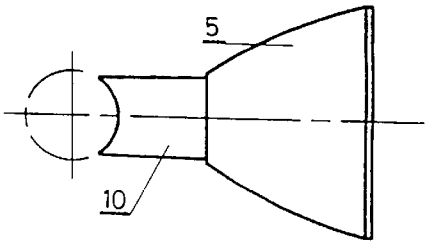
FIG. 9 is a lateral elevation of said body.
Figure 6:
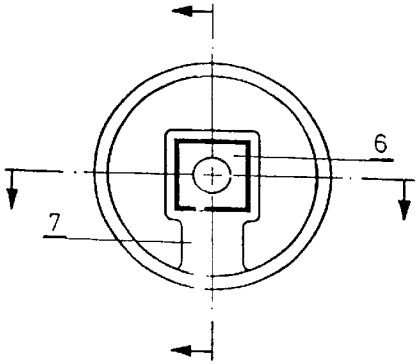
FIG. 6 is an elevation of the trimming body seen from its back side, with which it connects to the back piece.
Figure 10:
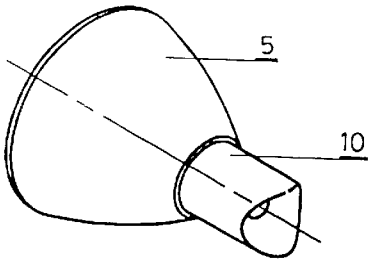
FIG. 10 a perspective view of the same.
Figure 7:
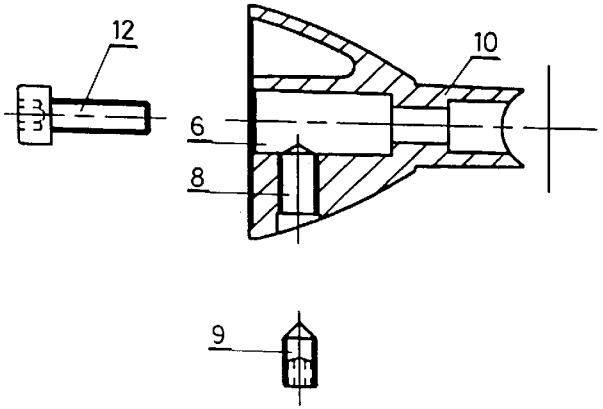
FIG. 7 is a section of same through the plane along line A—A in FIG. 6.
Figure 8:
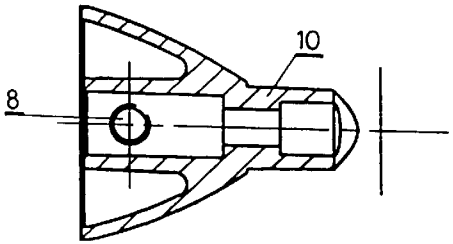
FIG. 8 is a section through the plane along line B—B in FIG. 6.
Figure 13:
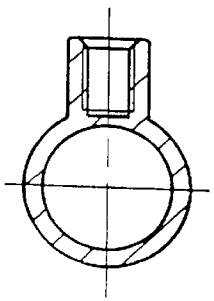
FIG. 13 in transverse section through the plane along line A—A in FIG. 12.
Figure 14:
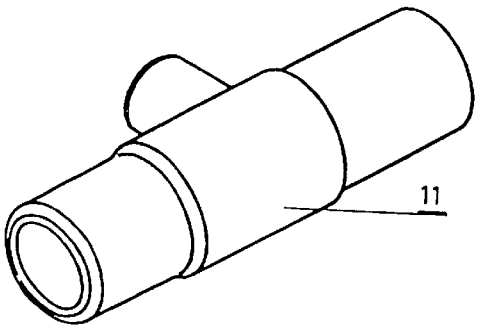
FIG. 14 is a perspective view of said T-piece.
Figure 12:
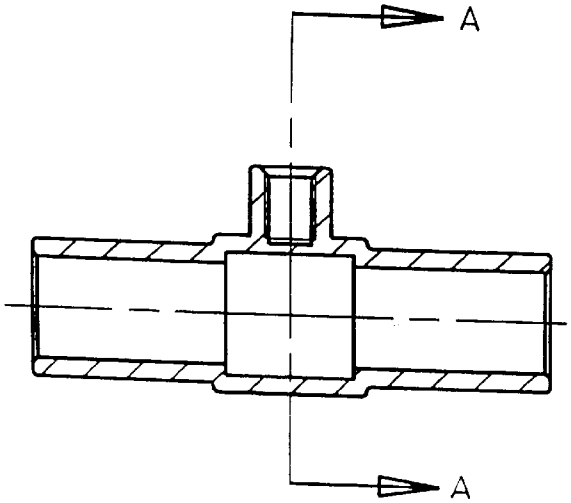
FIG. 12 shows the same in longitudinal section.
Figure 11:
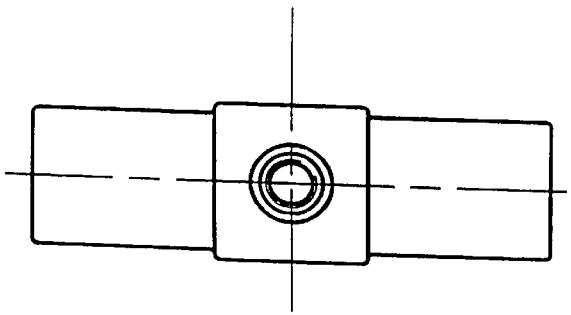
FIG. 11 shows from below the tubular T-piece.
Figure 17:
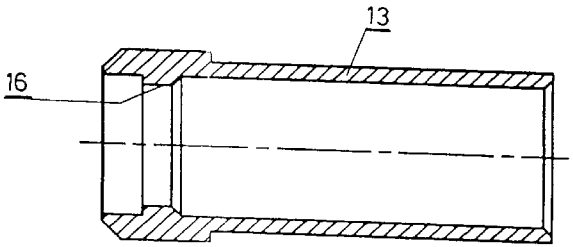
FIG. 17 is a longitudinal section through the plane along line B—B in FIG. 15.
Figure 18:
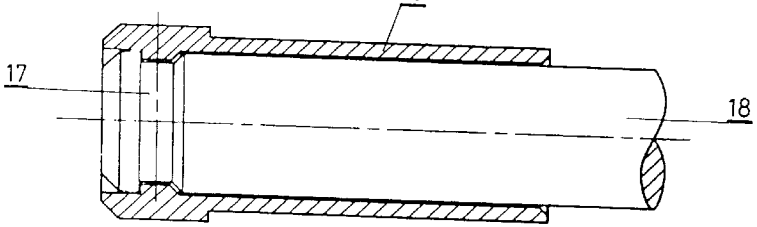
FIG. 18 represents the tight fit of a sleeve in the end of an accessory support rod "clipped" to the transverse arm of the tubular T-piece. Lastly.
Figure 16:
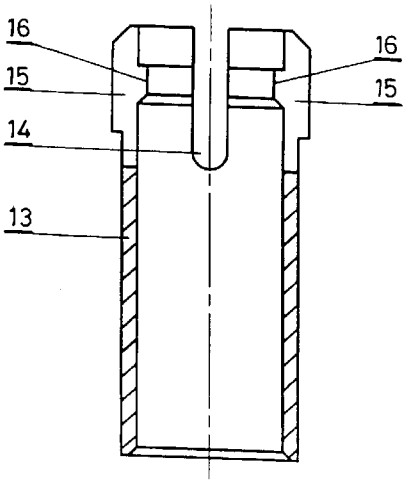
FIG. 16 is a longitudinal section of the same through the plane along line A—A in FIG. 15.
Figure 15:
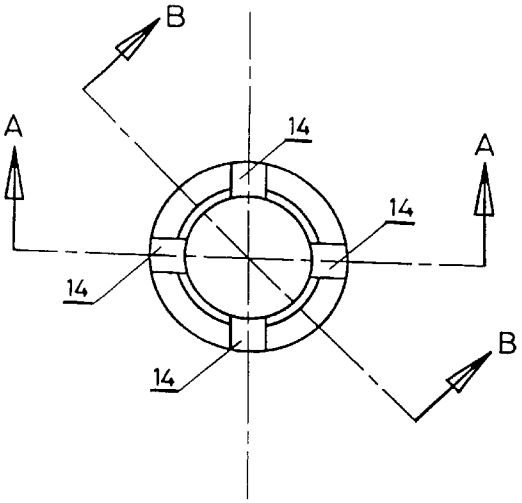
FIG. 15 represents one of the elastic sleeves in frontal elevation through the end which comprises depressions.
Figure 19:
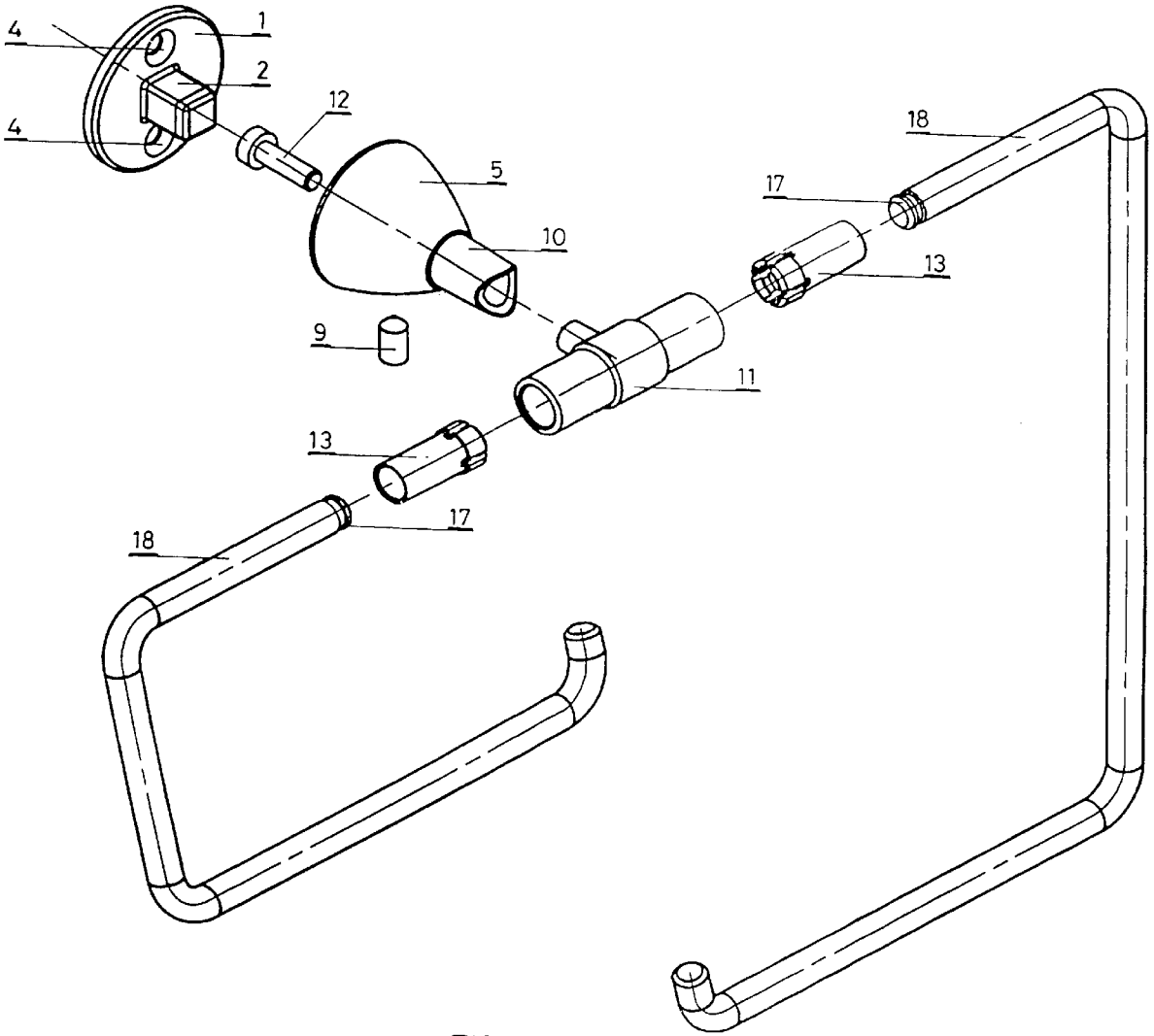
FIG. 19 shows an example of the exploded view of the system in its specific application, in this case the accessory being attached is a double toilet paper roll holder.

In order to clarify the nature and scope of the advantageous application of the "system for fastening bathroom accessories" which is the object of the claimed invention, its structure and assembly are described with reference to the drawings, which, since they represent a preferred embodiment of said object, of an informational character, it must be considered in its broadest sense and not as limiting its applications and the contents of the claimed invention.

The structure of the system comprises the following elements:

A back piece (1) for fastening to the wall, in the shape of a thin disk, which has on its front side a central protrusion (2) shaped like a right rectangular prism, which, in its lower side, when in the position of use, has a circular penetration (3), and has two throughholes (4) placed along a diameter vertical to it, on each side of the central prism (2).

A bell-shaped trimming body (5) whose lateral surface is shaped like that of a semi-ellipsoid of revolution, which in its interior has a tubular volume (6) centered along its axis, square in shape and with interior dimensions slightly larger than the exterior dimensions of the central prism (2) of the back piece (1), to allow tight introduction of the latter into the former; and which in the lower portion of the tubular volume (6), in its position of use, has a solid extension (7) traversed vertically by a threaded hole (8) which emerges at the outside, for the passage of a set-screw (9) whose end is placed into the circular penetration (3) of the interior prism (2) of the back piece (1), joining it securely and immovably to the trimming body (5); having also a cylindrical tubular extension (10) in the polar region of the ellipsoidal surface and co-axial with it.

A T-shaped cylindrical tubular piece (11) whose central arm is threaded on the inside and has an outer diameter tightly adjusted to the inner diameter of the cylindrical extension (10) of the trimming body (5) in order to facilitate its placement inside it, the joining of the two pieces being accomplished by means of an Allen screw (12) which is introduced through said tubular extension (10) and the threading in the central arm of the T-piece (11), the end of said tubular extension (10) being fitted to the transverse body of said T-piece (11), by means of the suitable configuration.

Two sleeves (13) of a semi-elastic material which are of uniform diameter approximately two-thirds of their length, while the remaining third is of a slightly larger diameter and has four straight depressions (14) in the direction of their generatrix, two of each facing one another, in as many orthogonal axes, and each of the keys (15) thus formed having thickenings (16) in their respective inner surface which allow them to be joined under pressure through circumferential slots (17) which the straight outgoing rods (18) of the transverse arm of the T-piece (11) comprise near their ends, whose function is the support of the corresponding accessory.

The assembly of the system is accomplished according to the following sequence of operations:

Fastening of the back piece (1) to the wall by means of screws and wall plugs.

Joining of the trimming body (5) and the T-piece (11) by means of an Allen screw (12) introduced through the tubular extension (10) of the trimming body (5) and threaded into the central arm of the T-piece (11) which is located in said extension (10);

Joining of the back piece (1) and the trimming body (5) joined to the T-piece (11) by means of the lower set screw (9);

Joining of the T-piece (11) and the support rods (18) of the accessories by means of several semi-elastic sleeves (13) introduced first into the T-piece (11) through its castellated portion and subsequently into the ends of the rods (18) through their straight cylindrical portion, the two elements thus being "clipped" in a virtually irreversible manner.

What is claimed is:

1. A system for fastening bathroom accessories characterized thereby that it comprises the following elements:

a back piece (1) for attachment to a wall, the back piece having the shape of a thin disk, which has on its front side a central protrusion (2) shaped like a right rectangular prism which in its lower side, when in the position of use, has a circular penetration (3), the back piece has two throughholes (4) placed along a diameter vertical to said protrusion, on each side of the central prism (2);

a bell-shaped trimming body (5) whose lateral surface is shaped liked that of a semi-ellipsoid of revolution, which in its interior has a tubular volume (6) centered along its axis, square in shape and with inner dimensions slightly larger than the outer dimensions of the central prism (2) of the back piece (1), to allow the tight introduction of the latter into the former; and which in the lower portion of the tubular volume (6), in its position of use, has a solid extension (7) traversed vertically by a threaded hole (8) which emerges at the outside, for the passage of a set-screw (9) whose end is placed into the circular penetration (3) of the internal prism (2) of the back piece (1), joining it securely and immovably to the trimming body (5); the trimming body having also a cylindrical tubular extension (10) in the polar region of the ellipsoidal surface and co-axial therewith;

a T-shaped cylindrical tubular piece (11) whose central arm is threaded on the inside and which has an outer diameter tightly adjusted to the inner diameter of the cylindrical extension (10) of the trimming body (5) in order to facilitate its placement inside it, the joining of the two pieces being accomplished by means of an Allen screw (12) which is introduced through said tubular extension (10) and the threading in the central arm of the T-piece (11), the end of said tubular extension (10) accommodating the transverse body of said T-piece (11) by means of a suitable configuration;

two sleeves (13) of a semi-elastic material which are of uniform diameter approximately two-thirds of their length, while the remaining third is of a slightly larger diameter, and having four straight depressions (14) in the direction of their generatrix, two of each facing one another, in as many orthogonal axes, and each of the keys (15) thus formed having thickenings (16) in their respective inner surface which allow them to be joined under pressure to circumferential slots (17) of straight outgoing rods (18) which form at least a portion of the accessory.

2. The system for fastening bathroom accessories according to claim 1 characterized thereby that its assembly is accomplished according to the following sequence of operations:

fastening of the back piece (1) to the wall by means of screws and wall plugs.

joining of the trimming body (5) and the T-piece (11) by means of an allen screw (12) introduced through the tubular extension (10) of the trimming body (5) and threaded into the central arm of the T-piece (11) which is located inside said extension (10);

joining of the back piece (1) and the trimming body (5) joined to the T-piece (11) by means of the lower set screw (9);

joining of the T-piece (11) and the support rods (18) of the accessories by means of several semi-elastic sleeves (13) introduced first into the T-piece (11) into the ends of the rods (18) through their straight cylindrical portion, both elements thus being clipped in a virtually irreversible manner.

* * * * *